United States Patent [19]

Koisuka et al.

[11] Patent Number: 4,620,590

[45] Date of Patent: Nov. 4, 1986

[54] ALUMINUM HEAT EXCHANGER

[75] Inventors: Mikio Koisuka; Hisao Aoki, both of Gunma, Japan

[73] Assignee: Sanden Corporation, Gunma, Japan

[21] Appl. No.: 678,400

[22] Filed: Dec. 5, 1984

[51] Int. Cl.[4] ..... F28F 1/00

[52] U.S. Cl. ..... 165/150; 165/153; 165/178; 285/24; 29/157 T

[58] Field of Search ..... 165/150, 151, 152, 153, 165/178; 285/24, 27, 31, 330; 29/157 T, 726

[56] References Cited

U.S. PATENT DOCUMENTS 4,353,224 10/1982 Nonogaki et al. ..... 165/110 X

FOREIGN PATENT DOCUMENTS 2054779 2/1981 United Kingdom ..... 285/24

*Primary Examiner*—William R. Cline

*Assistant Examiner*—Richard R. Cole

*Attorney, Agent, or Firm*—Hopgood, Calimafde, Kalil, Blaustein & Judlowe

[57] ABSTRACT

A heat exchanger having a flat tube with a plurality of fluid passageways therein, header pipes connected to opposite ends of the flat tube and inlet and outlet tubes connected to the header pipes, respectively. The inlet and outlet tubes are inserted and fitted into the corresponding ones of the header pipes and formed with axial slits in the inserted end portions. The opposite ends of the flat tube extend into header pipes through axial slits in the outer surfaces thereof and are fitted into the axial slits of the inlet and outlet tubes inserted therein. Thus, the inlet tube and the outlet tube are reliably maintained in their desired orientation. The header pipes are made of aluminum brazing sheet and, therefore, are brazed to the aluminum flat tube and the inlet and outlet aluminum tubes.

5 Claims, 4 Drawing Figures

ALUMINUM HEAT EXCHANGER

BACKGROUND OF THE INVENTION (1) Field of the Invention

This invention relates to heat exchangers, and in particular, to heat exchangers having a flat metal tube with a plurality of fluid passageways, and fluid inlet and outlet tubes connected to the flat metal tube through header pipes on opposite ends of the flat metal tube.

(2) Description of the Prior Art

As a typical heat exchanger having a flat metal tube with a plurality of fluid passageways therein, and fluid inlet and outlet tubes connected to the flat metal tubes through header pipes on opposite ends of the flat metal tube, a serpentine-type heat exchanger is known in the prior art which is used for, for example, a refrigerant evaporator in automotive air conditioning system, as shown in, for example, U.S. Pat. Nos. 4,350,025 and 4,353,224.

The serpentine heat exchanger comprises the flat metal tube formed in a serpentine-anfractuous shape to have a plurality of parallel portions spaced apart from one another. A plurality of corrugated fin units are disposed in spaces between adjacent parallel portions of the flat tube and are joined thereto by brazing. Header pipes are fixedly mounted on opposite ends of the flat tube, respectively, and an inlet tube and an outlet tube are connected to the header pipes, respectively.

In U.S. Pat. No. 4,353,224, only header pipes are shown at 3 and 4 in FIG. 1 of the drawing, while header pipes are shown at 3 and 5 in FIG. 5 of U.S. Pat. No. 4,350,025 which are integral with the inlet tube and the outlet tube, respectively.

In practical arrangement, header pipes are formed as different parts from the inlet and outlet pipes and are connected thereto.

The flat tube and the fin units are made of high heat-conductivity materials, such as aluminum alloys. Usually, the serpentine-anfractuous flat tube is made of an aluminum metal having 99 wt. % or more Al, for example, AA (Aluminum Association in U.S.A.) 1050 which comprises, by weight, 0.25% or less Si, 0.40% or less Fe, 0.05% or less Cu, 0.05% or less Mn, 0.05% or less Mg, 0.05% or less Zn, 0.03% or less Ti and 99.50% or more Al, or AA 3003 which comprises, by weight, 0.6% or less Si, 0.7% or less Fe, 0.05–0.20% Cu, 1.0–1.5% Mn, 0.10% or less Zn and the balance Al. The corrugated fin unit is made of an aluminum alloy brazing sheet which has a core metal of, for example, AA 3003 with a cladding of an aluminum alloy brazing filler metal, such as AA 4343, 4045 or 4047 (which comprises, by weight, 0.30% or less Cu, 5–13% Si, 0.8% or less Fe, 0.15% or less Mn, up to 0.1% Mg, 0.20% or less Zn, up to 0.20% Ti, and the balance substantially Al).

The corrugated fin units of the aluminum alloy brazing sheet are assembled to the serpentine-anfractuous flat tube of the aluminum alloy, and thereafter, deposited into a brazing surface. Thus, corrugated fin units are brazed and joined to the flat tube.

Header pipes are usually made of the aluminum alloy brazing sheet similar to the corrugated fin unit. The header pipes are assembled onto the flat tube before being deposited into the brazing furnace. Therefore, the header pipes are also brazed and joined to the flat tube while brazing the corrugated fin units to the flat tube.

Thereafter, the inlet tube and the outlet tube are connected to respective header pipes by, for example, TIG (Tungsten-inert gas) welding, while maintaining predetermined orientations of the tubes. The connecting operation is difficult and, therefore, is a factor in the high cost of the heat exchanger.

SUMMARY OF THE INVENTION

It is therefore an object of the present invention to provide a heat exchanger having a flat metal tube, header pipes brazed and joined to opposite ends of the flat tube, and an inlet tube and an outlet tube connected to the header pipes, respectively, wherein the inlet tube and the outlet tube are reliably and easily maintained in predetermined orientations with reference to the flat tube and the header pipes during and after a connecting operation of the inlet tubes and the outlet tubes to the headers.

It is another object of the present invention to provide a heat exchanger wherein connection of the inlet tube and the outlet tube to headers can be performed simultaneously with brazing of the headers to the flat tube.

A heat exchanger has a flat metal tube having a plurality of fluid passageways therein, a plurality of metal fins joined thereto, header pipes mounted on opposite ends of the flat tube, and an inlet and an outlet tube connected to header pipes, respectively, as described above. The present invention is characterized in that at least one of the inlet and outlet tubes is partially and axially cut away at an end portion that is inserted into the corresponding one of the header pipes. An end of the flat tube projects into the corresponding header pipe and is fitted into said cut-away portion of said one of the inlet and outlet tubes.

The said one of the inlet and outlet tubes is reliably maintained at a desired orientation. This means that the joining or connecting operation of said one tube to the corresponding header pipe is readily performed.

Further objects, features and other aspects will be understood from the following detailed description of preferred embodiments referring to the accompanying drawings.

DETAILED DESCRIPTION OF PREFERRED EMBODIMENTS

Figure 1:
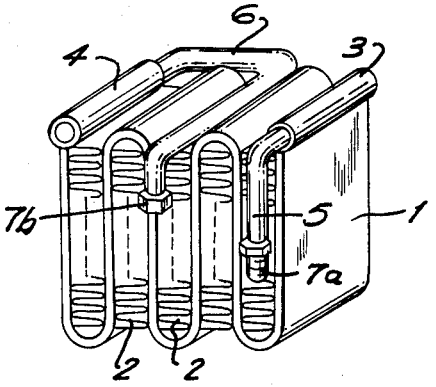
FIG. 1 is a perspective view of a typical serpentine-type heat exchanger according to the present invention.

Referring to FIG. 1, a heat exchanger according to an embodiment of the present invention generally has an arrangement similar to a typical serpentine-type heat exchanger. The heat exchanger has a serpentine-anfractuous flat tube 1 of, for example, an aluminum alloy AA 1050. Corrugated fin units 2 are made of, for example, aluminum alloy brazing sheet which has a core metal AA 3003 with cladding of an aluminum alloy brazing filler metal of AA 4045 (which comprises, by weight, 0,30% or less Cu, 9.0–11.0% Si, 0.8% or less Fe, 0.05% or less Mn, 0.05% or less Mg, 0.10% or less Zn, 0.20% or less Ti, and the balance substantially Al). The corrugated fin units 2 are disposed in spaces between adjacent parallel portions of the serpentine-anfractuous flat tube 1. Corrugated fin units are brazed and joined to flat tube 1 by heating the flat tube and the corrugated fin units so assembled thereto in a brazing furnace to melt the cladding metal of the brazing sheet.

Figure 2:
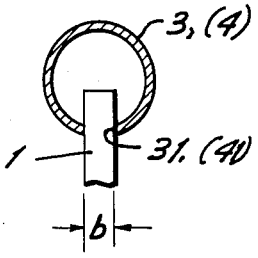
FIG. 2 is a cross-sectional view of a connecting portion of a header pipe and a flat tube.

Two header pipes 3 and 4 are fixedly mounted on opposite end portions of flat tube 1 so that a plurality of fluid passageways in the flat tube communicate with interiors of header pipes 3 and 4. Each header pipe 3 and 4 has one open end and the other closed end, and is made of an aluminum alloy brazing sheet similar to the corrugated fin unit. Each header pipe 3 and 4 is provided with a long axial opening or an axial slot 31 and 41, as shown in FIG. 2, in the outer surface in which the corresponding end portion of flat tube 1 is inserted. In this condition, each header pipe 3 and 4 and flat tube 1 are heated in a brazing furnace, and thereby, brazed and joined to one other.

Therefore, joining of corrugated fin units 2 to flat tube 1 and joining of header pipes 3 and 4 to flat tube 1 are performed simultaneously during the same brazing step by preassembling the corrugated fin units and the header pipes to the flat tube.

An inlet tube 5 and an outlet tube 6 are inserted in the open ends of header pipes 3 and 4, respectively, and joined and connected thereto with predetermined orientations.

In the prior art, inlet tube 5 and outlet tube 6 are inserted into header pipes 3 and 4 previously brazed to flat tube 1, and are connected or joined thereto by, for example, TIG welding, as mentioned hereinabove. The joining operation is difficult because each tube 5 and 6 must be maintained in a predetermined orientation during the operation. If the tube 5 or 6 moves from the predetermined orientation, a free end of the tube, which is provided with coupling means (shown at *7a* and *7b* in FIG. 1) for connecting with an external fluid pipe, is not located at a predetermined position with reference to the heat exchanger body.

Figure 3:
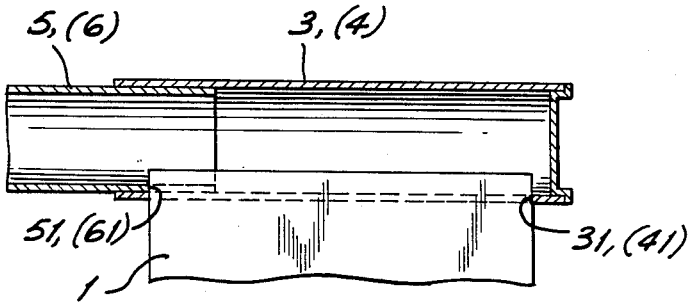
FIG. 3 is a longitudinal sectional view of a connecting portion of a header pipe, a flat tube and an inlet/outlet tube.
Figure 4:
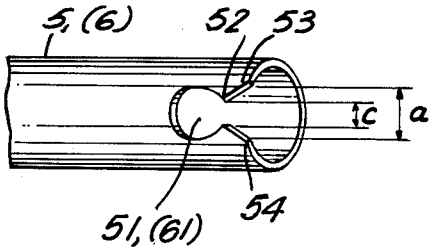
FIG. 4 is a perspective view illustrating an end portion of an inlet/outlet tube to be inserted into a header pipe.

According to the present invention, referring to FIGS. 3 and 4, inlet tube 5 is partially and axially cut away at the end portion thereof that is inserted into header pipe 3, thereby to form a slit 51 extending axially along the tube from the inserted end. The axial length of the slit 51 is predetermined less than the axial length of the end portion of the tube 5 that is inserted into header pipe 3. The circumferential width of axial slit 51 is determined in correspondence with the thickness of flat tube 1.

The end portion of flat tube 1 that is inserted into header pipe 3 through slot 31 is also inserted into the axial slit 51 of inlet pipe 5. Thus, inlet tube 5 is prevented from rotation by engagement of axial slit 51 and flat tube 1 so that inlet tube 5 is readily maintained at its desired orientation during the joining process. The angular position of axial slit 51 is determined by the desired orientation of inlet tube 5.

A preferred contour of slit 51 is shown in FIG. 4. The slit has an intermediate portion 52 (with a width of c) slightly less than the thickness (b) of flat tube 1 and a tapered portion 53 enlarged towards the open end 54 (with a width of a), where $a>b>c$.

Outlet tube 6 is also provided with an axial slit like the slit 51, as shown in FIGS. 3 and 4, into which an end portion of flat tube 1 that is inserted into header pipe 4 is fitted in a similar manner as shown in FIG. 3. Thus, the outlet tube is also maintained at its desired orientation. Therefore, reference numerals 6, 4, 61 and 41 of the associated outlet tube, header pipe, axial slit and axial slot are written within parentheses in FIGS. 2, 3 and 4, alongside the reference numerals designating the corresponding similar parts previously described, and detailed description thereof is omitted for purpose of simplification of the description.

According to the arrangement, inlet tube 5 and outlet tube 6 are maintained at their desired positions after being assembled together with header pipes 3 and 4 and flat tube 1. Therefore, inlet tube 5 and outlet tube 6 can be brazed to header pipes 3 and 4, respectively, at the same time that the corrugated fin units and the header pipes are brazed to the flat tube during brazing using a brazing furnace. That his, inlet tube 5 and outlet tube 6 are made of an aluminum alloy, such as, AA 3003. The inlet tube and the outlet tube are assembled, together with the flat tube, the header pipes and the corrugated fin units, as shown in FIG. 1, and thereafter, the assembly is loaded in a brazing furnace to heat the assembly. Then, the cladding metals of the header pipes melt so that the header pipes are brazed to not only the flat tube but also the inlet tube and the outlet tube, respectively. At the same time, the cladding metals of the corrugated fin units melt to braze the corrugated fin units to the flat tube. Thus, the heat exchanger having an inlet tube and an outlet tube can be produced through a single brazing step, without any further operation for connecting the inlet or outlet tube to the header pipe.

In the above-mentioned embodiment, both of the inlet and outlet tubes are provided with the axial slits. In another embodiment, only one of them may be formed with an axial slit. In that embodiment, the other tube is connected or joined to the corresponding header pipe in a similar manner to that used in the prior art. However, it should be noted that the connecting operation of the tube having the axial slit to the corresponding header pipe is reliably and readily performed.

What is claimed is:

1. In a heat exchanger comprising a flat metal tube for conducting fluid having opposite first and second ends, a plurality of metal fins fixed onto outer surfaces of said flat metal tube, first and second header pipes fixedly mounted on said opposite ends of said flat metal tube, respectively, so that said flat metal tube communicates with the interior of said header pipes, each of said header pipes having a first end that is open and a second end that is closed, an inlet tube connected to said first end of said first header pipe, and an outlet tube connected to said first end of said second header pipe, the improvement which comprises one of said inlet and outlet tubes having an end portion inserted into said first end of the corresponding interconnected header pipe, said end portion having a cut-away portion in the form of a first axial slit extending axially inwardly from an open end at the adjacent end of said one tube, said first axial slit having an axial intermediate portion slightly smaller than the thickness of said flat metal tube, and a tapered portion diverging towards said open end of said first axial slit, and said first end of said flat metal tube extending into said corresponding interconnected header pipe and being closely fitted into said first axial slit.

2. The heat exchanger as claimed in claim 1, wherein the other one of said inlet and outlet tubes has a second end portion inserted into said first end of the header pipe connected thereto, said second end portion having a cut-away portion in the form of a second axial slit extending axially inwardly from an open end at the adacent end of said other one of said inlet and outlet tubes, said second axial slit having an axial intermediate portion slightly smaller than the thickness of said flat metal tube, and a tapered portion diverging towards said open end of said second axial slit, and said second end of said flat metal tube extends into said corresponding interconnected header pipe and is closely fitted into said second axial slit.

3. The heat exchanger as claimed in claim 1, wherein said flat tube is formed in a serpentine-anfractuous shape in a longitudinal direction of said tube to have a plurality of parallel portions spaced apart from one another, said fins are constituted of a plurality of corrugated fin units, each corrugated fin unit is interposed between, and joined to, adjacent ones of said parallel portions of said flat tube.

4. The heat exchanger as claimed in claim 1, wherein said flat tube and said one of the inlet and outlet tubes are made of an aluminum alloy, said fins are constituted of corrugated fin units which are made of an aluminum alloy brazing sheet having a core metal of an aluminum alloy with cladding of an aluminum alloy brazing filler metal, said corrugated fin units are brazed to said flat tube by said brazing filler metal, each of said two header pipes is made of an aluminum brazing sheet having a core metal of an aluminum alloy with cladding of an aluminum alloy brazing filler metal, each of said two header pipes is brazed to said flat tube by said brazing filler metal thereof, and said one of the inlet and outlet tubes is also brazed to said corresponding one of the header tubes by the brazing filler metal.

5. The heat exchanger as claimed in claim 4, wherein the other one of said inlet and outlet tubes has a second end portion inserted into said first end of the header pipe connected thereto and has an axially partially cut away portion in said second end portion, and said second end portion of said flat metal tube extends into said corresponding interconnected header pipe and is fitted into said axial cut-away portion of said other one of the inlet and outlet tubes, and said other one of said inlet and outlet tubes is made of an aluminum alloy and is brazed to the other one of said inlet and outlet tubes by the brazing filler metal of said other one tube.

* * * * *